US009683181B2

(12) United States Patent
Kumar et al.

(10) Patent No.: US 9,683,181 B2
(45) Date of Patent: Jun. 20, 2017

(54) PROCESS FOR CONTROLLING THE TEMPERATURE OF A FEED STREAM TO AN ISOMERIZATION ZONE

(71) Applicant: UOP LLC, Des Plaines, IL (US)

(72) Inventors: Manoj Kumar, Haryana (IN); Sriharinadh Narisetty, Haryana (IN); David James Shecterle, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 420 days.

(21) Appl. No.: 14/478,496

(22) Filed: Sep. 5, 2014

(65) Prior Publication Data

US 2016/0068762 A1 Mar. 10, 2016

(51) Int. Cl.

| | |
|---|---|
| ***C10G 65/04*** | (2006.01) |
| ***C10G 45/72*** | (2006.01) |
| ***C10G 35/24*** | (2006.01) |
| ***C10G 61/02*** | (2006.01) |

(52) U.S. Cl.

CPC ..... *C10G 65/043* (2013.01); *C10G 35/24* (2013.01); *C10G 45/72* (2013.01); *C10G 61/02* (2013.01); *C10G 2300/4006* (2013.01)

(58) Field of Classification Search

CPC ..... C10G 65/043; C10G 45/58; C10G 45/72; C07C 5/22–5/2702; C07C 5/2767–5/277

See application file for complete search history.

(56) References Cited

U.S. PATENT DOCUMENTS

| | | | |
|---|---|---|---|
| 5,082,989 | A | 1/1992 | Johnson |
| 6,573,417 | B1 | 6/2003 | Rice |
| 7,223,898 | B2 | 5/2007 | Rice |
| 7,875,757 | B2 | 1/2011 | Nafis et al. |
| 2013/0096356 | A1 | 4/2013 | Bharuka et al. |

FOREIGN PATENT DOCUMENTS

WO WO 2013/147787 A1 10/2013

OTHER PUBLICATIONS

Fernandez et al., "UOP's New Once-Through Hydrogen Penex Technology . . . " National Petroleum Refiners Association Annual Meeting (1988), Mar. 20-22, San Antonio, TX, pp. 1-24.

*Primary Examiner* — Renee Robinson

(57) ABSTRACT

A process for heating a feed stream to an isomerization zone by passing the feed stream though heat exchangers and heating the feeds stream with reactor effluent from the isomerization zone. The effluent from the last reactor is passed to a stabilization column and then a separation column, preferably without heating the feed stream. The separation column may also be heated with effluent from a reactor in the isomerization zone.

8 Claims, 1 Drawing Sheet

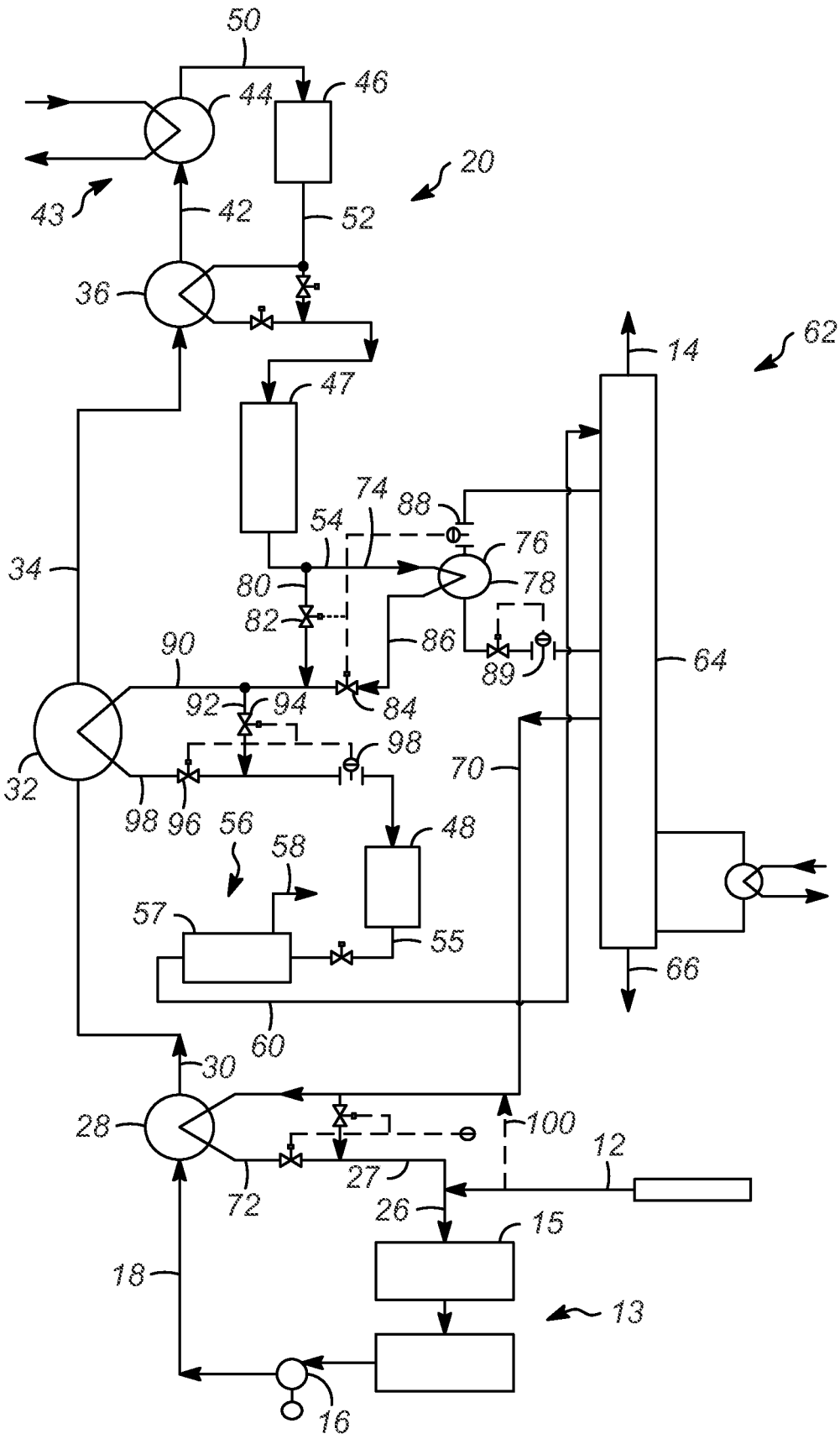
50
44
46
20
43
42
52
36
14
62
47
74
88
54
76
34
80
78
82
86
90
89
64
92
94
84
98
32
70
98
96
56
48
58
57
55
66
60
30
28
100
12
27
72
26
15
18
13
16

PROCESS FOR CONTROLLING THE TEMPERATURE OF A FEED STREAM TO AN ISOMERIZATION ZONE

FIELD OF THE INVENTION

This invention relates generally to methods for the isomerization and separation of hydrocarbon feeds, and more particularly the invention relates to such methods that provide enhanced heat recovery.

BACKGROUND OF THE INVENTION

Isomerization and separation of hydrocarbons are well developed and widely practiced in the petrochemical and petroleum refining industries. One constant concern for petrochemical and petroleum refiners is the utility consumption of isomerization processing units and separation units, for example, deisohexanizing processing units. One method of reducing utility consumption in isomerization processing is to use a heat exchange between hot streams with excess heat and cooler streams in need of energy. For instance, one known process flow in a typical isomerization process is to heat the feed stream by indirect heat exchange against the effluent of the isomerization zone.

While current methods are able to utilize heat energy from effluent isomerization streams to preheat a feedstock, the methods typically still require large amounts of utility consumption. For instance, some methods typically utilize additional heating of feedstock by passing the feedstock stream through a steam heater or a similar available source of high temperature heat. Due to the large scale of the processing, even a nominal improvement in energy efficiency can significantly reduce utility consumption.

Many isomerization and separation methods involve isomerization zones having multiple reactors. For example, in WO 2013/147787, an isomerization zone is disclosed which comprises three reactors. An effluent from each reactor is passed through a heat exchanger to heat the feed stream to the isomerization zone. U.S. Pat. Pub. No. 2013/0096356 discloses a similar method in which the isomerization zone includes two reactors.

While these methods may provide improved heat recovery from prior methods, it is desirable to provide methods and apparatuses for the isomerization and separation of hydrocarbon feeds that provide enhanced heat recovery. In addition, it is desirable to provide methods and apparatuses for the isomerization and separation of hydrocarbon feeds that exchange heat between the feed and a separation column. Other desirable features and characteristics will become apparent from the subsequent detailed description and the appended claims, taken in conjunction with the accompanying drawings and this background.

SUMMARY OF THE INVENTION

One or more processes for efficiently controlling the temperature of a feed stream to an isomerization zone have been discovered.

In a first aspect of the invention, the invention may be characterized as a process for controlling a temperature of a feed stream passed to an isomerization zone in which the process comprises: combining a feed stream with a stream from a first separation column; heating the feed stream in a first heat exchanger; heating the feed stream in a second heat exchanger; heating the feed stream in a third heat exchanger; heating the feed stream in a charge heater; passing the feed stream to an isomerization zone having at least one reactor and a stabilization zone; and, passing an effluent stream from at least one reactor to the stabilization zone without heating the feed stream in a heat exchanger, wherein the stream from the separation column heats the feed stream in the first heat exchanger.

In at least some embodiments of the present invention, the isomerization zone comprises a plurality of reactors. It is contemplated that a process includes heating the feed stream in at least the third heat exchanger with at least a portion of an effluent from a first reactor from the plurality of reactors. It is further contemplated that a process also includes heating the feed stream in at least the second heat exchanger with at least a portion of an effluent from a second reactor from the plurality of reactors. It is still further contemplated that a process includes heating a separation column with the effluent stream from the second reactor. The first separation column may comprise the separation column heated with the effluent stream from the second reactor. It is contemplated that the first separation column is heated by the effluent stream from the second reactor with a sidedraw reboiler. It is even further contemplated that a process includes controlling a flow of the effluent stream from the second reactor through the sidedraw reboiler by adjusting a valve in a bypass line. The bypass line may be configured to pass a portion of the effluent stream from the second reactor around the sidedraw reboiler. Additionally, a pressure differential controller may be disposed in an outlet for the sidedraw reboiler. A flow controller and a control valve may be disposed in an inlet for the sidedraw reboiler. It is contemplated that a process further includes controlling a flow of the effluent stream from the second reactor through the second heat exchanger by adjusting a second valve. The second valve may be disposed in a second bypass line downstream from the first bypass line. Additionally, a temperature controller may be disposed downstream of the second heat exchanger.

In a second aspect of the invention, the invention may also be characterized as a process controlling a temperature of a feed stream passed to an isomerization zone, in which the process comprises: combining a feed stream with a stream from a first separation column; heating the feed stream in a first heat exchanger; heating the feed stream in a second heat exchanger; heating the feed stream in a third heat exchanger; heating the feed stream in a charge heater; passing the feed stream to an isomerization zone; and, separating a portion of an effluent from the isomerization zone in the first separation column. The stream from the separation column heats the feed stream in the first heat exchanger. The isomerization zone comprises at least three reactors.

In at least one embodiment, the process includes heating the feed stream in the third heat exchanger with at least a portion of an effluent from the first reactor in the isomerization zone. It is contemplated that a process further includes heating the feed stream in the second heat exchanger with at least a portion of an effluent from the second reactor in the isomerization zone. It is contemplated that the process includes passing an effluent stream from the third reactor to a stabilization zone and maintaining the temperature of the effluent stream passed to the stabilization zone.

It is contemplated that a separation column is heated with at least one of the effluent from the first reactor and the effluent from the second reactor. It is further contemplated that the process includes controlling the heating of the separation column with at least one of the effluent from the first reactor and the effluent from the second reactor by adjusting a flow of the at least one of the effluent from the first reactor and the effluent from the second reactor.

It is also contemplated that a process includes adjusting the flow of the at least one of the effluent from the first reactor and the effluent from the second reactor between a heat exchanger and a reactor.

It is even further contemplated that a process includes heating a second separation column with the effluent from the first reactor and heating a third separation column with the effluent from the second reactor.

In at least one embodiment, the first separation column comprises a deisohexanizer column.

In a third aspect of the invention, the invention may be characterized as a process for controlling a temperature of a feed stream passed to an isomerization zone, in which the process includes: combining a feed stream with a stream from a separation zone; heating the feed stream in a first heat exchanger, wherein the stream from the separation zone heats the feed stream in the first heat exchanger; heating the feed stream in a second heat exchanger, wherein the feed stream is heated in the second heat exchanger by an effluent from an isomerization reactor; heating the feed stream in a third heat exchanger, wherein the feed stream is heated in the third heat exchanger by an effluent from another isomerization reactor downstream from the isomerization reactor which produces an effluent to heat the feed stream in the second heat exchanger; heating the feed stream in a heating zone; passing the feed stream to the isomerization zone; passing an effluent stream from the isomerization zone to the stabilization zone; and, maintaining the temperature of the effluent stream passed to the stabilization zone.

Additional objects, embodiments, and details of the invention are set forth in the following detailed description of the invention.

DETAILED DESCRIPTION OF THE DRAWINGS

In the drawings, the FIGURE shows a simplified process diagram of one or more embodiments of the present invention.

DETAILED DESCRIPTION OF THE INVENTION

One or more methods have been developed in which a feed stream to an isomerization zone is heated with effluent from one or more reactors in the isomerization zone. The effluent from the isomerization zone is separated. In order to control the temperature of the feed stream entering the isomerization zone, and to efficiently recover heat from one or more separation columns, at least one stream from a separation column may also be used to heat the feed stream. The effluent from the isomerization zone may be passed from the final reactor to a stabilization column without transferring heat to the feed stream.

Depending on the operational configuration of various zones and units, for example a stabilization column, or a separation column, the processes according to the present invention can provide for energy savings for the overall process. For example, a process according to one or more embodiments of the present invention is believed to provide for lower stabilization column reboiler duty, as well as lower duty for a feed air cooler. In some embodiments of the present invention, a process provides for a lower duty for a bottoms reboiler of a separation column. In both cases, the lower duty results in lower operating costs, as well as lower size requirements. Any capital expenditures required for additional equipment could be offset by the savings associated with lower operating costs.

The following detailed description is intended to be merely exemplary in nature and is not intended to limit the scope of the invention to the methods and apparatuses described. Furthermore, there is no intention to be bound by any theory presented in the preceding background or the following detailed description. Also, additional components, loops, and processes may be included in the apparatuses and methods described herein but are not described for purposes of clarity. Stream compositions presented herein are merely illustrative of an embodiment and are not intended to limit the methods and apparatuses in any way.

The UOP Penex™ process is a continuous catalytic process used in the refining of crude oil. The process isomerizes hydrocarbon feeds into higher octane, branched molecules. For example, a hydrocarbon feed such as light naphtha, which typically comprises $C_4$ to $C_7$ paraffins and $C_5$ to $C_7$ cyclic hydrocarbons, and often primarily comprises $C_5$ and $C_6$ paraffins, may be isomerized into higher-octane, branched $C_5/C_6$ molecules. The process typically uses reactors with high activity chlorinated alumina-type platinum catalysts. A single pass of feedstock with an octane rating of 50 to 60 through such a reactor typically produces an end product rated at 82 to 86. To obtain a higher octane rating, the feedstock may be subsequently passed through a separation zone, typically including at least a deisohexanizer (DIH) unit. After deisohexanizing, the end product typically has an octane rating of 87 to 90.5.

Methods and apparatuses for isomerization and deisohexanizing of hydrocarbon feeds are contemplated herein. The methods and apparatuses achieve enhanced heat recovery through heat exchange between separation and isomerization stages. To that end, heat is exchanged between a separation column and the feed into the isomerization unit. For example, a sidecut from a deisohexanizer unit can be used. As a result, heat energy is efficiently transferred between the separation zone and the isomerization zone within the apparatus, and the need for additional heat input from outside the apparatus is reduced.

As shown in the FIGURE, in an exemplary process a hydrocarbon feed stream 12 is isomerized to create a product 14. In an exemplary embodiment, the feed stream 12 may be primarily comprised of $C_5$ and $C_6$ paraffins and include some $C_7$ paraffins. Certain feed streams 12 may include between 1% and 5%, 10%, or even more than 10%, $C_7$ paraffins. The processing of a hydrocarbon feed stream 12 having other compositions is also contemplated. As will be discussed below, the feed stream 12 is preferably combined with a stream 27 from a separation zone 62 to form a combined feed in a line 26 (discussed below).

In the depicted embodiment, the combined feed 26 is passed through a drying zone 13 having one or more driers 15, received by a charge pump 16, and then fed through a line 18 toward an isomerization zone 20. Although not depicted as such, the output of the charge pump 16 may be combined with make-up hydrogen. Preferably the make-up hydrogen is delivered after having been dried by dryer to eliminate any water or sulfur content therein. Prior to reaching the isomerization zone 20, the temperature of the combined feed stream 26 must be increased.

Accordingly, the combined feed stream 26 in line 18 is first heated by a first heat exchanger 28. The exact position at which the feed stream 12 is combined with the stream 27 from the separation zone 62 to form the combined feed stream 26 can change depending, for example, on a temperature of the feed stream 12 or the stream 27 from the separation zone 62. As will be described in more detail below, as shown, the feed stream 12 is combined with a stream 70. Thus, the described embodiment is merely exemplary and not intended to be limiting.

A line 30 delivers the output of the first heat exchanger 28 to a second heat exchanger 32 for further heating. The output of the second heat exchanger 32 then flows through a line 34 for heating by a third heat exchanger 36. It is contemplated, although not shown, that an injector adds a chloride source, such as perchloroethylene, to the heated output of the third heat exchanger 36 in a line 42. The combined feed stream 26 in line 42 is then heated in a heating zone 43 by, for example, a charge heater 44 or the like. The charge heater 44 is a steam heated exchanger which is used to achieve the required temperature for introduction of the combined feed stream 26 into the isomerization zone 20.

As shown, the isomerization zone 20 includes an isomerization unit comprised of a three isomerization reactors 46, 47, 48. While three reactors are shown, in certain embodiments there may be either one or two or more isomerization reactors. The reactors 46, 47, 48 may be substantially identical. In certain embodiments, the catalyst used in the isomerization zone 20 is distributed equally between the reactors 46, 47, 48. In other embodiments, there may be differing catalyst distributions. The use of multiple reactors 46, 47, 48 facilitates a variation in the operating conditions between the reactors to enhance iso-paraffin production and improve cyclic hydrocarbon conversion. In this manner, the first reactor 46 can operate at higher temperature conditions that favor ring opening but performs only a portion of the normal to iso-paraffin conversion. The heat exchangers upstream of the first isomerization reactor 46, facilitate the use of higher temperatures in the first isomerization reactor 46. Once cyclic hydrocarbon rings have been opened by initial contact with the catalyst, the downstream reactors 47, 48 may operate at temperature conditions that are more favorable for iso-paraffin equilibrium.

The first isomerization reactor 46 can operate at any suitable temperature, such as a temperature of about 90° C. to about 235° C., preferably about 110° C. to about 205° C., and the pressure can be about 700 to about 7,000 KPa. The liquid hourly space velocities may range from about 0.5 to about 12 $hr^{-1}$. The catalyst used in the first isomerization reactor 46 may include a strong acid catalyst, such as at least one of a chlorided platinum alumina, a crystalline aluminosilicate or zeolite, a sulfated zirconia, and a modified sulfated zirconia, preferably at least one of a chlorided platinum alumina and a sulfated zirconia. As a class, the crystalline aluminosilicate or crystalline zeolite catalyst may include a crystalline zeolitic molecular sieve having an apparent pore diameter large enough to adsorb neopentane. Generally, the catalyst may have a silica alumina molar ratio $SiO_2$:$Al_2O_3$ of greater than about 3:1 and less than about 60:1, and preferably about 15:1 to about 30:1. Catalysts of this type for isomerization and methods for preparation are disclosed in, e.g., U.S. Pat. No. 7,223,898.

The second isomerization reactor 47 can include, independently, the catalyst and operate similarly as the first isomerization reactor 46 discussed above. Preferably, the second isomerization reactor 47 may operate at a temperature of about 90° C. to about 180° C., preferably about 104° C. to about 175° C.

The third isomerization reactor 48 can include, independently, the catalyst and operate similarly as the first isomerization reactor 46 discussed above. Preferably, the third isomerization reactor 48 may operate at a temperature of about 90° C. to about 160° C.

As shown in the FIGURE, a line 50 delivers the output from the charge heater 44 to the first reactor 46 where isomerization at higher temperatures occurs, producing an effluent stream 52. The effluent stream 52 is directed to the third heat exchanger 36 where it heats the output of the second heat exchanger 32 carried in line 34.

The effluent stream 52 is then passed to the second isomerization reactor 47 where additional isomerization over the catalysts therein occurs at lower temperatures. As a result of the additional isomerization, a second effluent stream 54 is produced. The second effluent stream 54 is passed through the second heat exchanger 32 and heats the output of the first heat exchanger 28 carried in the line 30.

Finally, the second effluent stream 54 is passed to the third isomerization reactor 48 (or most downstream reactor) where additional isomerization over the catalysts therein occurs at even lower temperatures. As a result of the additional isomerization, and since (at least in this embodiment, the third isomerization reactor 48 is the most downstream reactor), a final isomerization effluent 55 exits the isomerization zone 20.

The final isomerization effluent 55 exits the isomerization zone 20 and may enter a stabilization zone 56 which includes at least one stabilizer column 57. In various embodiments of the present invention, the temperature of the final isomerization effluent 55 is maintained as it is passed to the stabilization zone 56, or to the separation zone 62 (discussed below). In other words, unlike some process of the prior art, the final isomerization effluent 55 does not pass through a heat exchanger to transfer heat to the combined feed stream 26. While some heat may be lost during the passing of the final isomerization effluent 55 between zones, no heat is intentionally transferred to the feed stream 12. It is contemplated that the final isomerization effluent 55 passes through a feed-bottom exchanger for the stabilizer column 57 as it is passed to a separation zone 62.

As a result, the final isomerization effluent 55 has a higher temperature in the stabilization zone 56 if compared to designs in which the final isomerization effluent 55 is used to heat feed stream 12 in a heat exchanger. This higher temperature in the stabilization zone 56 results in energy savings as less energy is needed to heat the streams in the separation columns. In some embodiments of the present invention, it is contemplated that the stabilization zone 56 comprises a portion of the isomerization zone 20.

The stabilizer column 57 separates an overhead offgas product 58 typically containing HCl, hydrogen, and light hydrocarbons such as byproduct methane, ethane, propane and butane gases. The offgas product 58 is usually scrubbed to remove HCl and then may be routed to a central gas processing plant for removal and recovery of hydrogen, propane and butane. The residual gas after such processing may become part of the refinery's fuel gas system. The stabilizer column 57 forms a bottoms product 60 that includes liquid isomerate to be fed to a separation zone 62.

In a preferred separation zone 62, a deisohexanizer column 64 deisohexanizes the bottoms product 60 of the stabilizer column 57 and creates a high octane isomerate which may be the product 14 and a bottoms product 66. As shown, the deisohexanizer column 64 produces a sidecut stream 70. In an exemplary embodiment, the sidecut stream 70 is comprised primarily of normal hexane and monomethylpentanes, particularly normal hexane, 2-methylpentane and 3-methylpentane. The exemplary sidecut stream 70 may also contain cyclohexane, some dimethylbutanes, and some heavies. The sidecut stream(s) 70 having other compositions are contemplated herein, and are envisioned as a result of differing feedstocks and differing processing.

As shown in the FIGURE, the sidecut stream 70 is passed from the separation zone 62 through the first heat exchanger 28 to heat steam 18 downstream of the charge pump 16. The sidecut stream 70 then exits the first heat exchanger 28 via line 72.

The sidecut stream 70 may be combined with the feed stream 12. As shown in the FIGURE, via line 1100, it is contemplated that the feed stream 12 is combined with the sidecut stream 70 upstream of the first heat exchanger 28. Again, the position at which the feed stream 12 is combined with a stream containing hydrocarbons from the separation zone 62 may depend on the temperatures of the various streams.

As a result of the flow into the first heat exchanger 28, heat is exchanged between the separation zone 62 and the isomerization zone 20 upstream of the isomerization reactors, 46, 47, 48.

In an exemplary embodiment of the present invention, the temperature of the sidecut stream 70 may be about 104° C. when exiting the deisohexanizer column 64. As will be discussed below, the temperature of the sidecut stream 70 could be lowered further, for example to approximately 94° C., if it is combined with the feed stream 12 prior to passing to the first heat exchanger 28. After heat exchange at the first heat exchanger 28, the temperature of the stream 72 may be about 59° C. At the first heat exchanger 28, the temperature of the combined feed 26 in line 18 is raised from about 42° C. to about 75° C.

At the second heat exchanger 32, the fluid in line 30 is heated from about 75° C. to about 85° C., while the second isomerization effluent 54 is cooled from about 127° C. to about 117° C. At the third heat exchanger 36, the fluid from line 34 is heated to about 123° C., while the first isomerization effluent 52 is cooled from about 173° C. to about 120° C. The temperature of the stream 50 being passed into the isomerization zone is approximately 132, and the stream 55 leaving the third isomerization reactor 48 is approximately 120° C. it is believed that all of temperatures herein could be adjusted by approximately +/−5° C.

As a result of the increased temperature of the output from the third heat exchanger 36 in line 42, less energy is needed from the charge heater 44 before the isomerization reaction.

In order to further improve the energy retention of the process at least one effluent stream from an isomerization reactor that is not the most downstream reactor is used to heat both a heat exchanger heating the feed stream and a column in a separation zone.

For example, as shown in the FIGURE, in one or more embodiments of the present invention, the effluent stream 54 from the second isomerization reactor 47 is passed via a line 74 to a reboiler 76 of a column in the separation zone 62. In this embodiment, the separation column is the deisohexanizer column 64 and the reboiler 76 is a sidedraw reboiler 78. The sidedraw reboiler 78 is utilized due to the high temperature of the bottoms product in the deisohexanizer column 64. Other configurations could be used, for example, a deisopentanizer column could be used, and the reboiler 76 could be a bottoms product reboiler. Further, although the effluent stream 54 from the second isomerization reactor 47 is discussed with respect to this embodiment, it is contemplated that a different reactor in the isomerization zone 20 is used.

Returning to the FIGURE, in order to ensure a proper temperature exchange and keep the heat input of the sidedraw reboiler 78 constant, a bypass line 80 is provided upstream of the sidedraw reboiler 78. A valve 82 is disposed in the bypass line 80, and preferably a second valve 84, in relationship therewith, is disposed in an outlet 86 for the sidedraw reboiler 78. A pressure differential controller 88 can be used with the sidedraw reboiler 78, preferably on a cold side outlet, and be in communication with the valves 82, 84. If the differential pressure changes (indicating a % vaporization fluctuation), the valves 82, 84 can be adjusted to control the flow of the second reactor effluent 54 through the sidedraw reboiler 78. The valves 82, 84 preferably operate to split the effluent stream. By controlling both the feed rate to the cold side inlet of the sidedraw reboiler 78 and the cold side outlet % vaporization (via the pressure differential controller 88), a constant heat input to the sidedraw reboiler 78 is maintained even if the temperature of the second reactor effluent 54 varies.

Additionally, a flow controller 89 can be used in association with the sidedraw reboiler 78, preferably on a cold side inlet of the sidedraw reboiler 78.

In addition to the sidedraw reboiler 78, the second effluent stream 54 heats the combined feed 26 in the second heat exchanger 32. The use of the sidedraw reboiler 78 is meant to control the heat passed from the second effluent stream 54 to the combined feed 26 in the second heat exchanger 32. If too much heat is present in the second effluent stream 54, the temperature of the stream 34 may be too high such that charge heater 44 cannot achieve the proper temperature for stream 50 entering the isomerization zone 20. Other equipment or exchangers may be used instead of sidedraw reboiler 78 to ensure that the second effluent stream 54 achieves the proper temperature. After, the second effluent stream 54 flows through a line 90 to the second heat exchanger 32, the second effluent stream 54 passes to the next isomerization reactor, in this case, the third isomerization reactor 48.

In order to control the temperature of the third isomerization reactor 48 inlet, a second bypass line 92 may be used with also includes a valve 94. A second valve 96 may be disposed in an outlet 98 for the second heat exchanger 32, and the second valve 96 may be in relationship with the first valve 94. Both valves 94, 96 may be in communication with a temperature controller 98. Based upon the temperature, the flow through the valves 94, 96 can be adjusted.

The various process discussed above provide improved heat retention leading to greater energy savings, and thus lower operating costs, but minimizing heat loss associated with one or more process streams.

In order to demonstrate the principles of the present invention, a theoretical modeling was conducted comparing a known process to a process according to one or more embodiments of the present invention. For this theoretical modeling, a feed stream was combined with a stream from the separation zone upstream of the first heat exchanger. Additionally, the modeling involved maintaining the duty of the stabilizer reboiler. The calculations for the theoretical modeling are shown in TABLE 1, below.

TABLE 1

| | Prior Art (MMBtu/h) | Present Invention (MMBtu/h) |
|---|---|---|
| First Heat Exchanger Duty | 0 | 24 |
| Feed Stream Cooling Duty | 36 | 12 |
| Second and Third Heat Exchanger Duty | 52 | 38 |
| Charge Heater Duty | 8 | 8 |
| Stabilizer Feed Bottoms | 31 | 21 |

TABLE 1-continued

| | Prior Art (MMBtu/h) | Present Invention (MMBtu/h) |
|---|---|---|
| Exchanger Duty | | |
| Stabilizer Reboiler Duty | 69 | 69 |
| Deisohexanizer Sidedraw | 0 | 23 |
| Reboiler Duty | | |
| Deisohexanizer Bottoms | 165 | 142 |
| Reboilers Duty | | |
| Deisohexanizer Duty Savings | 23 (13.9%) | |
| Power (Feed Cooler) Savings | 24 (67%) | |

As can be appreciated based upon the results of the modeling in the TABLE 1, the process would provide for a lower duty deisohexanizer. It is believed that a similar result would occur if the duty of the deisohexanizer reboilers were maintained, allowing a savings of the duty associated with the stabilizer reboiler.

Based upon the above, it should be appreciated that a process according to the various embodiments provides effective energy transfer, lowering energy costs, and creating operating and capital savings for petroleum refiners and processors.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for controlling a temperature of a feed stream passed to an isomerization zone; the process comprising:

combining a feed stream with a stream from a first separation column;

heating the feed stream in a first heat exchanger;

heating the feed stream in a second heat exchanger;

heating the feed stream in a third heat exchanger;

heating the feed stream in a heating zone;

passing the feed stream to the isomerization zone comprising a plurality of reactors and a stabilization zone; and, passing an effluent stream from at least one reactor to the stabilization zone without using the effluent stream to heat the feed stream, wherein the stream from the separation column heats the feed stream in the first heat exchanger;

heating the feed stream in at least the third heat exchanger with at least a portion of an effluent from a first reactor from the plurality of reactors;

heating the feed stream in at least the second heat exchanger with at least a portion of an effluent from a second reactor from the plurality of reactors;

heating the first separation column by the effluent stream from the second reactor with an effluent stream from a sidedraw reboiler;

and controlling a flow of the effluent stream from the second reactor through the sidedraw reboiler by adjusting a valve in a bypass line, the bypass line being configured to pass a portion of the effluent stream from the second reactor around the sidedraw reboiler, wherein a pressure differential controller is disposed in an outlet for the sidedraw reboiler.

2. The process of claim 1 wherein a flow controller and a control valve are disposed in an inlet for the sidedraw reboiler.

3. The process of claim 2 further comprising:

controlling a flow of the effluent stream from the second reactor through the second heat exchanger by adjusting a second valve, the second valve being disposed in a second bypass line downstream from the first bypass line, wherein a temperature controller is disposed downstream of the second heat exchanger.

4. A process for controlling a temperature of a feed stream passed to an isomerization zone; the process comprising:

combining a feed stream with a stream from a first separation column;

heating the feed stream in a first heat exchanger;

heating the feed stream in a second heat exchanger;

heating the feed stream in a third heat exchanger;

heating the feed stream in a heating zone;

passing the feed stream to an isomerization zone comprising at least three reactors; and, separating a portion of an effluent from the isomerization zone in the first separation column;

heating the feed stream in the third heat exchanger with at least a portion of an effluent from the first reactor in the isomerization zone, heating the feed stream in the second heat exchanger with at least a portion of an effluent from the second reactor in the isomerization zone;

heating a second separation column with the effluent from the first reactor; and, heating a third separation column with the effluent from the second reactor;

wherein the stream from the separation column heats the feed stream in the first heat exchanger.

5. The process of claim 4 further comprising:

passing an effluent stream from the third reactor to a stabilization zone;

maintaining the temperature of the effluent stream passed to the stabilization zone.

6. The process of claim 4 further comprising:

heating a separation column with at least one of the effluent from the first reactor and the effluent from the second reactor.

7. The process of claim 6 further comprising:

controlling the heating of the separation column heating with at least one of the effluent from the first reactor and the effluent from the second reactor by adjusting a flow of the at least one of the effluent from the first reactor and the effluent from the second reactor.

8. The process of claim 4 wherein the first separation column comprises a deisohexanizer column.

* * * * *